US005548855A

United States Patent [19]

Jackson

[11] Patent Number: 5,548,855

[45] Date of Patent: Aug. 27, 1996

[54] VANITY FOR USE WITH A BATHTUB

[76] Inventor: Colleen J. Jackson, 64 Golfview La., Carpentersville, Ill. 60110

[21] Appl. No.: 350,610

[22] Filed: Dec. 7, 1994

[51] Int. Cl.[6] ..... A47K 3/00

[52] U.S. Cl. ..... 4/559; 4/549

[58] Field of Search ..... 4/546, 548, 549, 4/551, 559, 578.1, 597, 605; 211/88, 90, 104; 248/205.5, 206.3, 206.4; 312/233, 224, 245

[56] References Cited

U.S. PATENT DOCUMENTS

| | | | |
|---|---|---|---|
| 1,944,049 | 1/1934 | Weiler | 4/559 X |
| 2,302,806 | 11/1942 | Senter | 4/559 X |
| 3,239,850 | 3/1966 | Kiss | 4/559 |
| 4,400,835 | 8/1983 | Richter | 4/578.1 |
| 4,472,843 | 9/1984 | Chermak | 4/559 |
| 4,541,131 | 9/1985 | Sussman | 4/559 X |

FOREIGN PATENT DOCUMENTS

| | | | |
|---|---|---|---|
| 0659239 | 10/1951 | United Kingdom | 4/546 |

*Primary Examiner*—Charles E. Phillips
*Attorney, Agent, or Firm*—Mathew R. P. Perrone, Jr.

[57] ABSTRACT

A vanity including a cabinet and a door is mounted next to a bathtub. The door closes the cabinet in an up position and serves as a tray in a down position.

10 Claims, 6 Drawing Sheets

VANITY FOR USE WITH A BATHTUB

This invention relates to a vanity and more particularly to a vanity used in combination with a bathtub.

BACKGROUND OF THE INVENTION

A vanity and a bathtub are common items found in most bathrooms. Generally, the vanity includes a mirror and storage facilities for various items. These items are sometimes and, in fact, are usually required for use when a person is in the bathroom. Sometimes, however, it is desired to have these items stored in the vanity adjacent to the bathtub, so that the items may be used while a person is in the bathtub.

Such a positioning of the vanity requires a proper sizing and storage capability. This positioning must not interfere with the use of the bathtub. Also required is that the vanity include all necessary elements, including storage and support, for the proper function of the vanity as used in conjunction with the bathtub.

If the sizing of the vanity can be maximized so that the storage capacity thereof can be advantageously arranged, then the vanity purposes maximizing both storage and utility can be appropriately accomplished.

SUMMARY OF THE INVENTION

Among the many objectives of this invention is the provision of a vanity, which can be installed adjacent to a bathtub and effectively used therewith.

Another objective of this invention is to provide a vanity with a support tray.

Yet another objective of this invention is to provide a vanity with a mirror.

Still another objective of this invention is to provide a vanity with a mirror, which is easily stored.

Also, an objective of this invention is to provide a vanity, which can be more easily installed.

A further objective of this invention is to provide a vanity, which is removable.

A still further objective of this invention is to provide a vanity, which is permanently installed.

Yet a further objective of this invention is to provide a vanity, which is conveniently positioned.

These and other objectives of the invention (which other objectives become clear by consideration of the specification, claims and drawings as a whole) are met by providing a vanity including a cabinet and a door. The door closes the cabinet in an up position and serves as a tray in a down position.

BRIEF DESCRIPTION OF DRAWINGS

Throughout the figures of the drawings where the same part appears in more than one figure the same number is applied thereto.

DESCRIPTION OF PREFERRED EMBODIMENTS

Figure 1:
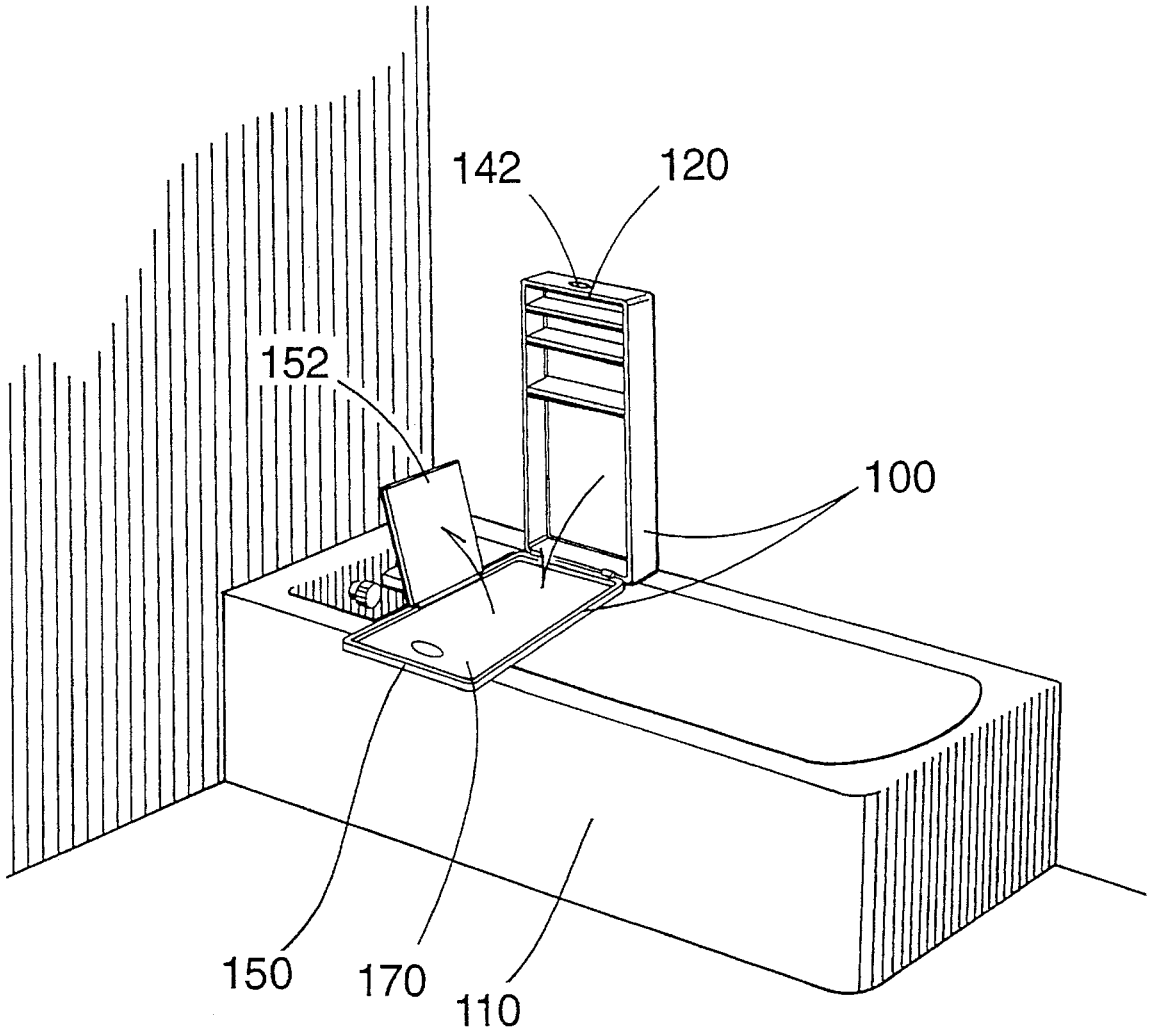
FIG. 1 depicts a perspective view of vanity 100 positioned adjacent to bathtub 110 with door 150 in a down position 170.

It is possible to achieve a bathtub vanity which may be attached to the area of the bathtub. This is accomplished by temporarily attaching or permanently attaching the vanity to the wall and adjacent to the bathtub.

Any suitable method may be used to temporarily attach the vanity adjacent to the tub. A set of four suction cups mounted on the rear corners of the cabinet is a preferred mounting device. It provides easily attaching and removing of the cabinet as desired. This assists the cleaning and repositioning without any permanent attaching member on the wall.

A variety of attaching members are operable. A hook and loop assembly available under the trademark VELCRO is operable. Brackets are also operable. Magnets may be assembled to achieve that attachment also.

Generally speaking, for the use of a handicapped person, it is desired that the vanity be convenient to the faucets and that the faucets be located in the wall as opposed to directly into the bathtub. That is to say that the faucets are along the long edge of the bathtub as opposed to the end thereof.

This vanity can include a door that may be folded downwardly and horizontally, in order to provide a tray for use with makeup, shampoo or other desired purposes. The door, now turned tray, includes a mirror which may pop up for various make-up chores or other functions. The vanity can also store shampoo, soap or other required materials, whether cosmetic or cleansing as desired. Generally speaking, this flexibility with the shelves therein permits storage and keeping the material handy at this time.

This bathtub-vanity can be attached to the back wall of the tub area approximately at an appropriate distance back from the faucets. This wall is preferably along a long side of the tub.

The cabinet is appropriately sized as desired. A preferred cabinet is about 50 to 60 centimeters high, 20 to 30 centimeters wide and 5 to 10 centimeters deep. The edges of the cabinet are preferably rounded, especially for the purpose of preventing injury.

The top of the cabinet may include a soap dish. It may be made of plastic or fiberglass. The front door of the cabinet may close over the outer edge with about a one to two centimeter lip. The door and cabinet are joined at a bottom edge of each with a molded hinge, which hinge may be secured with a pin.

When one opens the door of the vanity, the door rests from the hinge on the cabinet onto the opposite side of the tub. The door thus becomes a shelf to do nails, cups, or carry out any other desired function. The cabinet may also have shelves (preferably three in number) inside to accommodate shampoo bottles, nail polish, and similar material. In this fashion, size and utility are maximized.

The inside of the door also may have a pop-up mirror. The mirror is accessed when the door is in the down position in order for the door to serve as tray. The mirror is stored in the door when the vanity is closed.

The whole unit may be attached adjacent to the tub with suction cups or a similar temporary or removable device. Such a structure is clearly helpful to handicapped people who have to sit on a chair or lift, while in the bathtub. Every desired item can be placed conveniently in reach.

The bathtub vanity may also be designed for new construction or a remodelling project. It may be molded into the back section of the tub enclosure or built into the wall. This particular design may also have optional faucets built into the vanity itself with flexible faucet for again the handicapped person to be able to be more independent or just for anyone. The faucet may also have several different heads to use which can screw on and off for easy use. This also applies to faucet changes for ease of handicapped operation.

Figure 2:
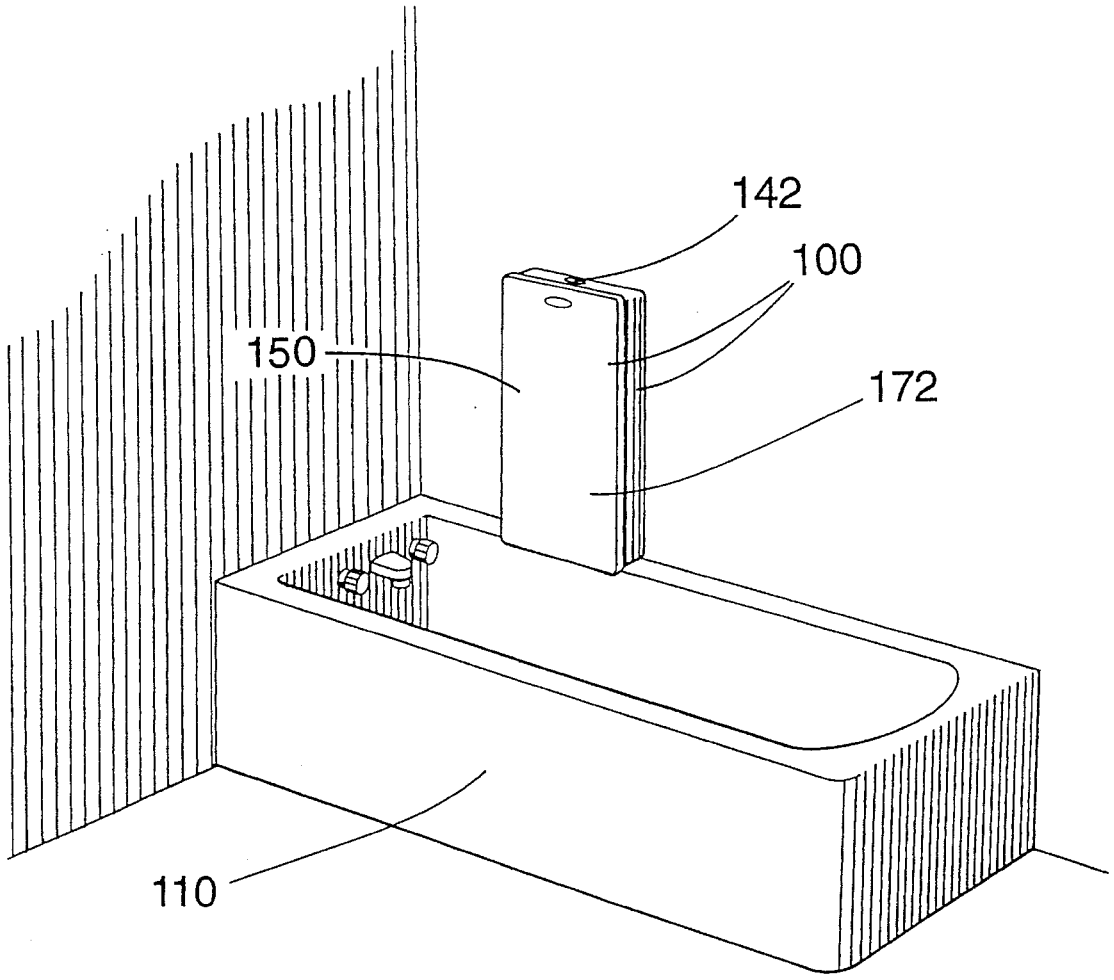
FIG. 2 depicts a perspective view of vanity 100 positioned adjacent to bathtub 110 with door 150 in an up position 172.

Referring now to FIG. 1, vanity 100 mounts adjacent to bathtub 110. Vanity 100 includes a cabinet 120 with a door 150 hingedly mounted thereto. Within the door 150 is a mirror 152 suitable for use. Within FIG. 2, the vanity 100 is shown with the door 150 in a closed, that is up position 172.

Figure 3:
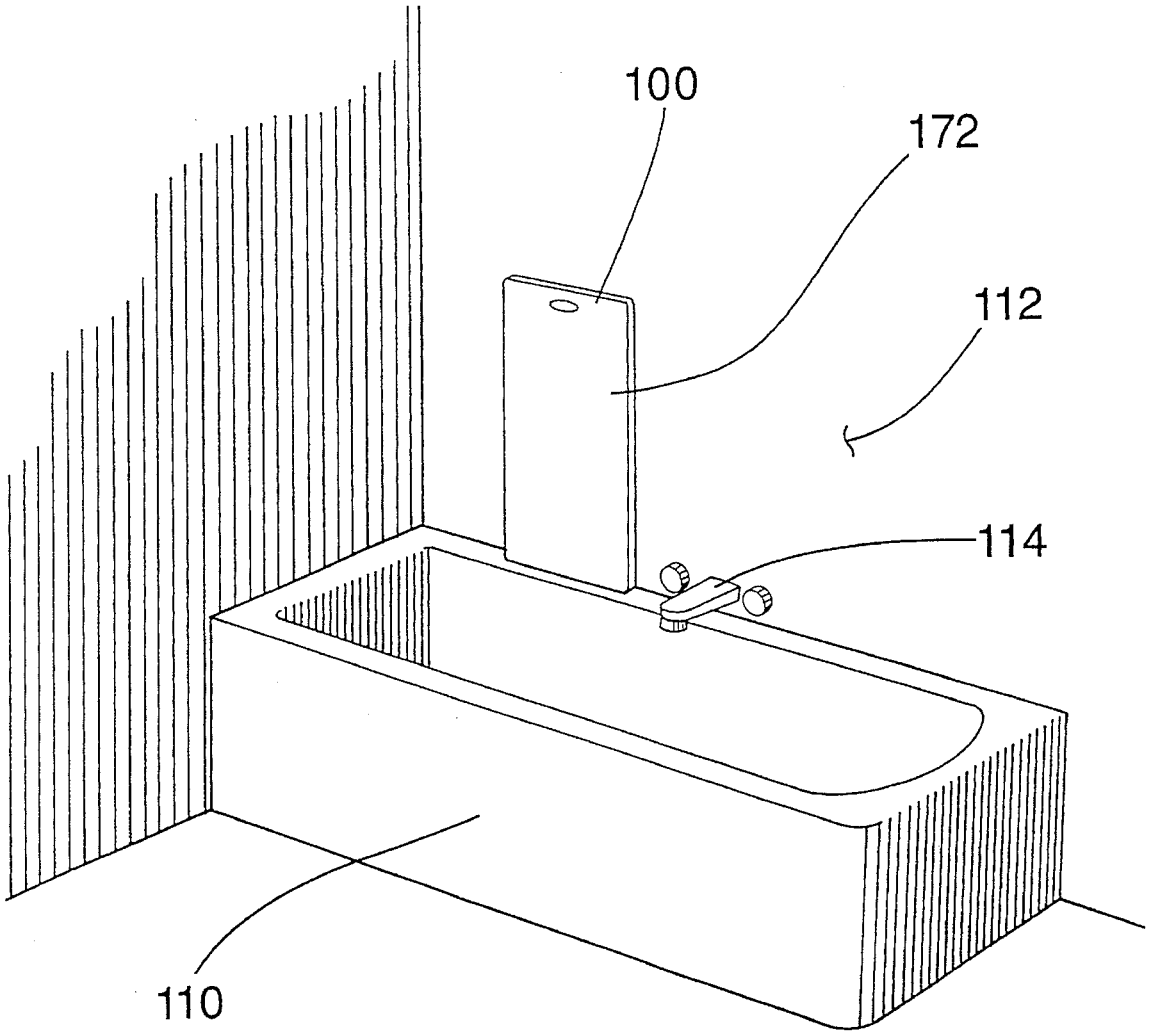
FIG. 3 depicts a perspective view of vanity 100 positioned and permanently installed adjacent to bathtub 110.

FIG. 3 depicts vanity 100 built into the wall 112 by the bathtub 110. This allows for flush mounting. Such a structure is clearly helpful to handicapped people who have to sit on a chair or lift, while in the bathtub 110. A convenient faucet assembly 114 may be mounted in standard fashion adjacent to the vanity 100. This faucet assembly 114 may also have other optional faucets built into the vanity itself with a flexible faucet for a physically challenged person to be able to be more independent.

Figure 4:
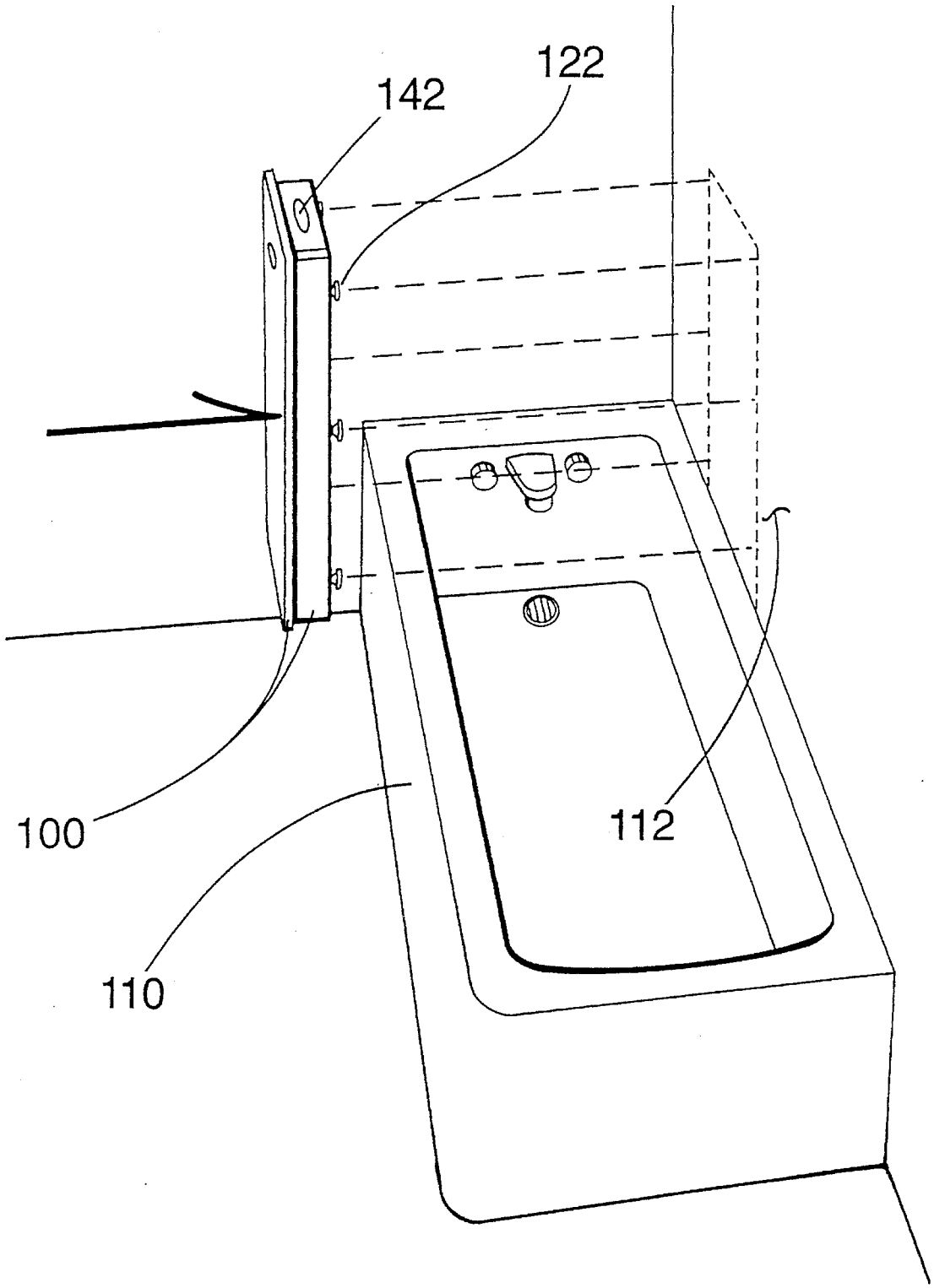
FIG. 4 depicts an exploded, perspective view of a removably attached vanity 100 positioned adjacent to bathtub 110 with door 150 in an up position 172.

In FIG. 4, vanity 100 is shown as being removably mounted to the wall 112 by suction cups 122. In this fashion, great flexibility is achieved through the vanity. The vanity can be moved and positioned appropriately and adjusted as desired.

Figure 5:
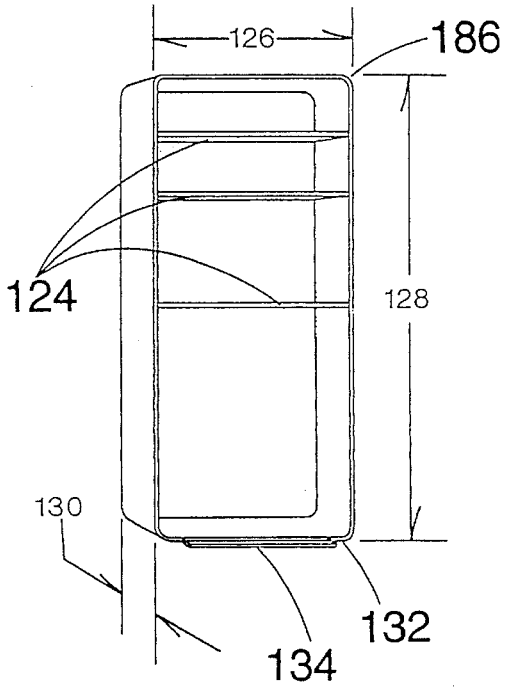
FIG. 5 depicts a perspective view of cabinet 120 for vanity 100.
Figure 9:
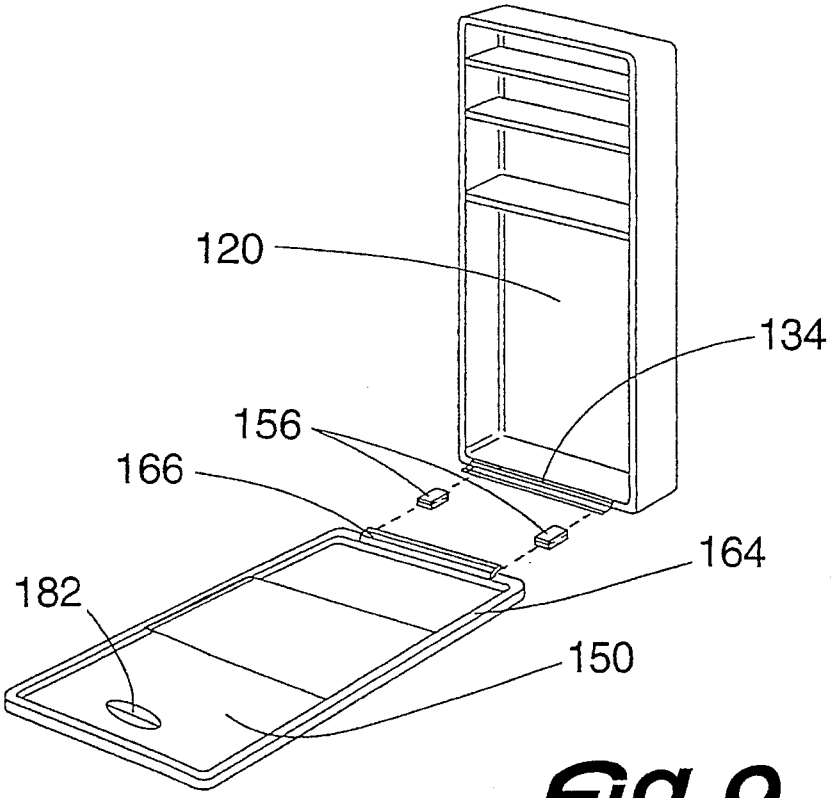
FIG. 9 depicts an exploded, perspective view of an attachment for door 150 to cabinet 120.

Referring now to FIG. 5 and FIG. 9, the vanity cabinet 120 is shown as having a plurality of shelves 124 therein. The vanity has an appropriate width 126 and height 128 and depth 130. This depth may be adjusted as desired.

Cabinet 120 includes four rounded corners 186 at the edge of the generally hollow rectangular shape. The rounded corners 186 improve the aesthetic appearance and avoid dangerous sharp corners, which may cause injury if a person makes hard contact therewith.

Attached to a bottom edge 132 of cabinet 120 is a hinge clamp 134. Hinge clamp 134 permits the attachment of door 150 to the cabinet 120 with hinge fasteners 156 (FIG. 6) onto door hinge 166 of door 150, which is secured in a standard fashion to the bottom thereof.

Figure 6:
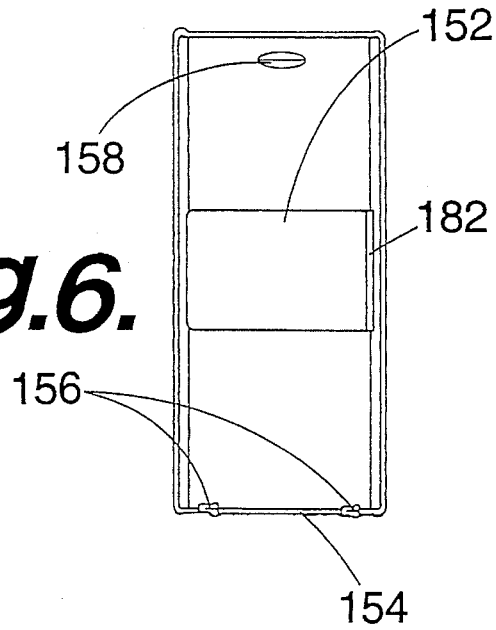
FIG. 6 depicts an inside plan view of door 150 for cabinet 120 for vanity 100.

Adding FIG. 6 to the consideration, door 150 is depicted from the inside 148 of door 150, which is adjacent to cabinet 120 in closed or up position 172. At the base 154 of door 150 are hinge fasteners 156 which join to hinge clamp 134 and secure door to cabinet 120.

The front door 150 of the cabinet 120 closes over the outer edge of cabinet 120 with an extending lip 164 thereon. Lip 164 frames the cabinet 120, when vanity 100 is viewed from the back side 136.

At the top 158 of the door 120 is a molded handle 158 as a part of the door 150. Molded handle 150 permits locking, opening and closing door 150, by having a latch capable of frictionally joining the cabinet 120 in order to hold the door 150 in position in an up position 172, when considered in combination with the hinge fastener 156.

Figure 7:
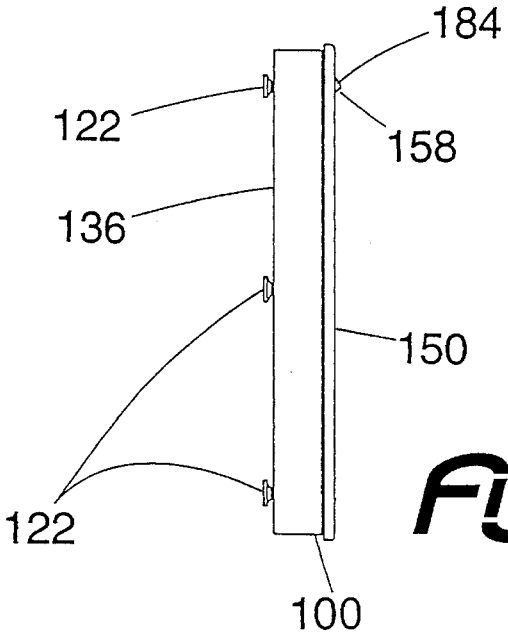
FIG. 7 depicts a side view of vanity 100 with door 150 in an up position 172.

With FIG. 7, suction cups 122 are shown as being capable of supporting cabinet 120 on the wall 112. In this fashion, the door 150 may be a tray for use. In the closed fashion, the tray aspect of door 150 is hidden.

As shown in FIG. 3, the cabinet 120 may be concealed in the wall 112. This permanently attaches the vanity 100 adjacent to the tub 110. With the suction cups 122 positioned properly on the back side 136 of the cabinet 120, it is possible to remove the vanity 100, and store or clean it as desired.

The molded handle assembly 158 on the interior of door 150 forms a latch 182 to hold the door 150 closed against the cabinet 120. The molded handle assembly 158 on the exterior of vanity 100 forms a grip 184, to permit the door 150 to be opened and used as tray or table.

Carry shelves 124 can be adjusted or positioned in any desired fashion. It is possible to provide a shelf adjusting mechanism of a standard type which need not be described here to permit the shelves to be so adjusted.

Figure 8:
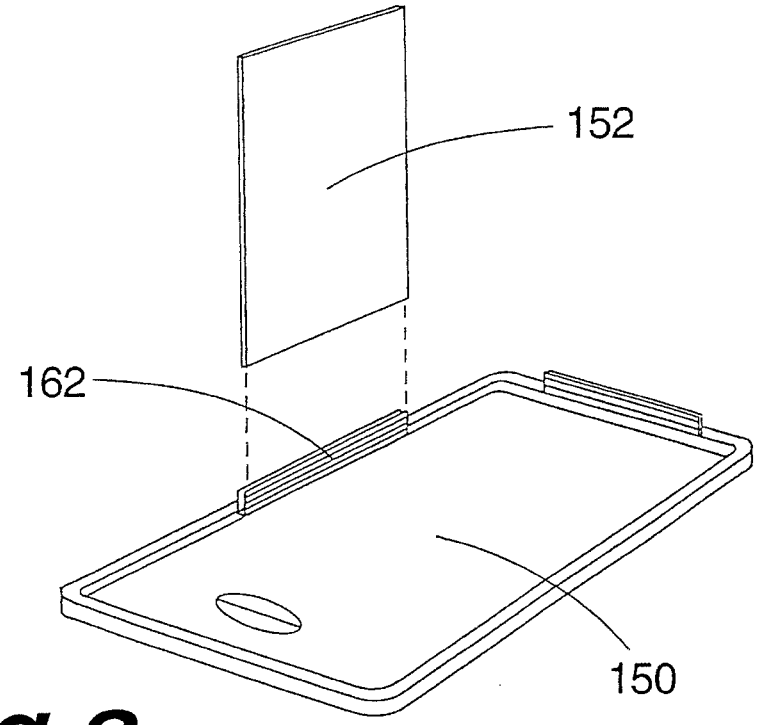
FIG. 8 depicts an exploded, perspective view of a mirror 152 attachment to door 150.

Within the door 150 and interior 152 is a mirror 152 as shown in FIG. 8. The mirror 152 is attached to the door 150 by mirror hinge 162. Mirror hinge 162 permits the rotation of mirror 152 into an upright position so that it may be used. Door 150 is of sufficient length to stretch from hinge clamp 134 to the other side of bathtub 110 thereby forming a tray which a person may use. Within the cabinet 120 may be contained make-up, shampoo or other desired materials for use in the tub 110.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A vanity for use in combination with a bathtub, comprising:

a) the vanity including a cabinet and a door;

b) the door having an up position in order to close the cabinet of the vanity;

c) the door having a down position in order to serve as a tray supported by the cabinet and the bathtub;

d) the vanity further including a fastening means to secure the vanity adjacent to the bathtub;

e) the fastening means being a temporary positioning device;

f) the bathtub including a water control means adjacent to the vanity;

g) the bathtub having a generally rectangular shape with a first long side oppositely disposed from a second long side, and a first short side oppositely disposed from a second short side;

h) the first long side being adjacent to a wall;

i) the water control means being adjacent to the vanity and the wall;

j) the temporary positioning device being suction cups;

k) the suction cups being mounted on a rear exterior panel of the cabinet;

l) the rear exterior panel of the cabinet being oppositely disposed from the door;

m) the door having a mirror situated thereon for use in the down position;

n) the cabinet having a hollow rectangular shape with a long open side;

o) the door being of sufficient length to close the long open side, when in the up position;

q) a top of the cabinet may including a soap holding means;

r) the cabinet and the door being joined with a hinge on one edge; and s) the cabinet having at least two shelves therein.

2. The vanity of claim 1 further comprising a) the cabinet having a height of about 50 to 60 centimeters, a width of about 20 to 30 centimeters wide and a depth of about 5 to 10 centimeters.

3. The vanity of claim 2 further comprising the door closing over the cabinet with about a one to two centimeter lip extending beyond the long open side.

4. The vanity of claim 1 further comprising the shelves being adjustable.

5. The vanity of claim 4 further comprising:

a) the door including a molded handle assembly;

b) the molded handle assembly including a latch on an interior of the door in order to hold the door closed against the cabinet; and c) the molded handle assembly including a grip on an exterior of the door to permit the door to be opened.

6. The vanity of claim 5 further comprising:

a) the mirror being attached to the door by a mirror hinge; and b) the mirror hinge including a locking means to hold the mirror upright for use.

7. In combination a bathtub and a vanity, the vanity comprising:

a) the vanity including a cabinet and a door;

b) the door having an up position in order to close the cabinet of the vanity;

c) the door having a down position in order to serve as a tray supported by the cabinet and the bathtub;

d) the vanity further including a fastening means to secure the vanity adjacent to the bathtub;

e) the fastening means being a temporary positioning device;

f) the bathtub including a water control means adjacent to the vanity;

g) the temporary positioning device being suction cups;

h) the suction cups being mounted on a rear exterior panel of the cabinet;

i) the rear exterior panel of the cabinet being oppositely disposed from the door having in the up position;

j) the bathtub having a generally rectangular shape with a first long side oppositely disposed from a second long side, and a first short side oppositely disposed from a second short side;

k) the first long side being adjacent to a wall;

l) the water control means being adjacent to the vanity and the wall;

m) the temporary positioning device being suction cups;

n) the suction cups being mounted on a rear exterior panel of the cabinet;

o) the rear exterior panel of the cabinet being oppositely disposed from the door having in the up position;

p) the door having a mirror situated thereon for use in the down position;

q) the cabinet having a hollow rectangular shape with a long open side;

r) the door being of sufficient length to close the long open side, when in the up position;

s) a top of the cabinet may including a soap holding means;

t) the cabinet and the door being joined with a hinge on one edge;

u) the cabinet having at least two shelves therein;

w) the shelves being adjustable;

x) the door including a molded handle assembly;

y) the molded handle assembly including a latch on an interior of the door in order to hold the door closed against the cabinet;

z) and a grip on an exterior of the door to permit the door to be opened.

8. The combination of claim 7 further comprising b) the cabinet having a height of about 50 to 60 centimeters, a width of about 20 to 30 centimeters wide and a depth of about 5 to 10 centimeters.

9. The combination of claim 8 further comprising the door closing over the cabinet with about a one to two centimeter lip extending beyond the long open side.

10. The combination of claim 7 further comprising:

a) the mirror being attached to the door by a mirror hinge; and b) the mirror hinge including a locking means to hold the mirror upright for use.

* * * * *